US006726516B2

(12) United States Patent
Sowry et al.

(10) Patent No.: US 6,726,516 B2
(45) Date of Patent: Apr. 27, 2004

(54) METHOD AND APPARATUS FOR ENABLING HAND TOOLS TO FLOAT

(76) Inventors: Michael M. Sowry, 1306 Mt. Vieja Dr., San Antonio, TX (US) 78213; Alan D. Sowry, 2409 Choctaw, Plano, TX (US) 75093

( * ) Notice: Subject to any disclaimer, the term of this patent is extended or adjusted under 35 U.S.C. 154(b) by 0 days.

(21) Appl. No.: 10/321,264

(22) Filed: Dec. 17, 2002

(65) Prior Publication Data

US 2003/0124922 A1 Jul. 3, 2003

Related U.S. Application Data

(60) Provisional application No. 60/343,957, filed on Dec. 27, 2001.

(51) Int. Cl.[7] ..... B63B 22/00
(52) U.S. Cl. ..... 441/1; 441/136; 81/489
(58) Field of Search ..... 441/1, 136, 133; 405/186; 81/489

(56) References Cited

U.S. PATENT DOCUMENTS

| | | | | | |
|---|---|---|---|---|---|
| 3,010,420 | A | | 11/1961 | Glynn | 114/222 |
| 4,407,213 | A | | 10/1983 | Evans | 114/222 |
| 4,664,637 | A | * | 5/1987 | Loerch | 440/101 |
| 4,672,745 | A | * | 6/1987 | Wilkens | 30/340 |
| 4,781,139 | A | | 11/1988 | Burgers | 114/222 |
| 5,088,948 | A | | 2/1992 | Scheurer | 441/1 |
| 5,209,176 | A | | 5/1993 | Pompei et al. | 114/222 |
| 5,235,355 | A | | 8/1993 | May | 351/123 |
| 5,601,003 | A | * | 2/1997 | Amtenbrink et al. | 81/489 |
| 5,680,679 | A | | 10/1997 | May | 24/3.2 |
| 5,727,709 | A | | 3/1998 | Nobile | 220/560 |
| 5,865,077 | A | * | 2/1999 | Moffitt et al. | 81/427.5 |
| 5,971,823 | A | | 10/1999 | Sanso | 441/88 |
| 6,029,845 | A | | 2/2000 | Mueller | 220/560 |

* cited by examiner

*Primary Examiner*—Jesus D. Sotelo
(74) *Attorney, Agent, or Firm*—Choate, Hall & Stewart

(57) ABSTRACT

A method and apparatus for enabling hand tools to float is disclosed. In one aspect, the invention is a grip comprising a tubular sleeve which is placed over a handle or pre-existing tool grip and enables the tool to float grip side up, thereby allowing the tool to be easily seen and retrieved. The grip may have varying thicknesses and diameters and may be colored or treated with a luminescent or reflective coating so as to be easily seen. The grip material may also be selected so that it molds to the user's hand during use.

13 Claims, 3 Drawing Sheets

METHOD AND APPARATUS FOR ENABLING HAND TOOLS TO FLOAT

CROSS-REFERENCE TO RELATED APPLICATIONS

The present application claims priority to U.S. Provisional Ser. No. 60/343,957, filed on Dec. 27, 2001, the teachings of which are incorporated herein by reference.

FIELD OF THE INVENTION

The present invention relates generally to the field of tools, and more particularly to a method and apparatus for enabling hand tools to float.

BACKGROUND OF THE INVENTION

For as long as man has used tools, improvements in their design and function have been welcomed. Handles and grips on tools have traditionally been manufactured out of wood, metal, bone and more recently synthetic compounds. Grips have been designed for a variety of reasons, including ergonomic issues, but tool buoyancy has seldom been considered.

Tools which do float have been manufactured out of non-metal materials. (See, e.g. U.S. Pat. No. 4,407,213 to Evans; and U.S. Pat. No. 4,781,139 to Burgers, the teachings of which are incorporated herein by reference). Tools manufactured out of materials other than metal are generally weaker than metal tools and are unsuitable for many applications in which metal tools are needed. Additionally, specially manufactured buoyant tools are not applicable to pre-existing tools already owned by a user.

Thus, there is a need for an apparatus which enables pre-existing hand tools to float.

SUMMARY OF THE INVENTION

The present invention discloses a grip which enables tools to float. In one aspect, the invention is a grip comprising a tubular sleeve which is placed over a handle or pre-existing tool grip and enables the tool to float grip side up, thereby allowing the tool to be easily seen and retrieved. The grip may have varying thicknesses and diameters and may be colored or treated with a luminescent or reflective coating so as to be easily seen. The grip material may also be selected so that it molds to the user's hand during use.

BRIEF DESCRIPTION OF THE DRAWING

The invention is described with reference to the several figures of the drawing, in which.

DETAILED DESCRIPTION OF THE INVENTION

Figure 1:
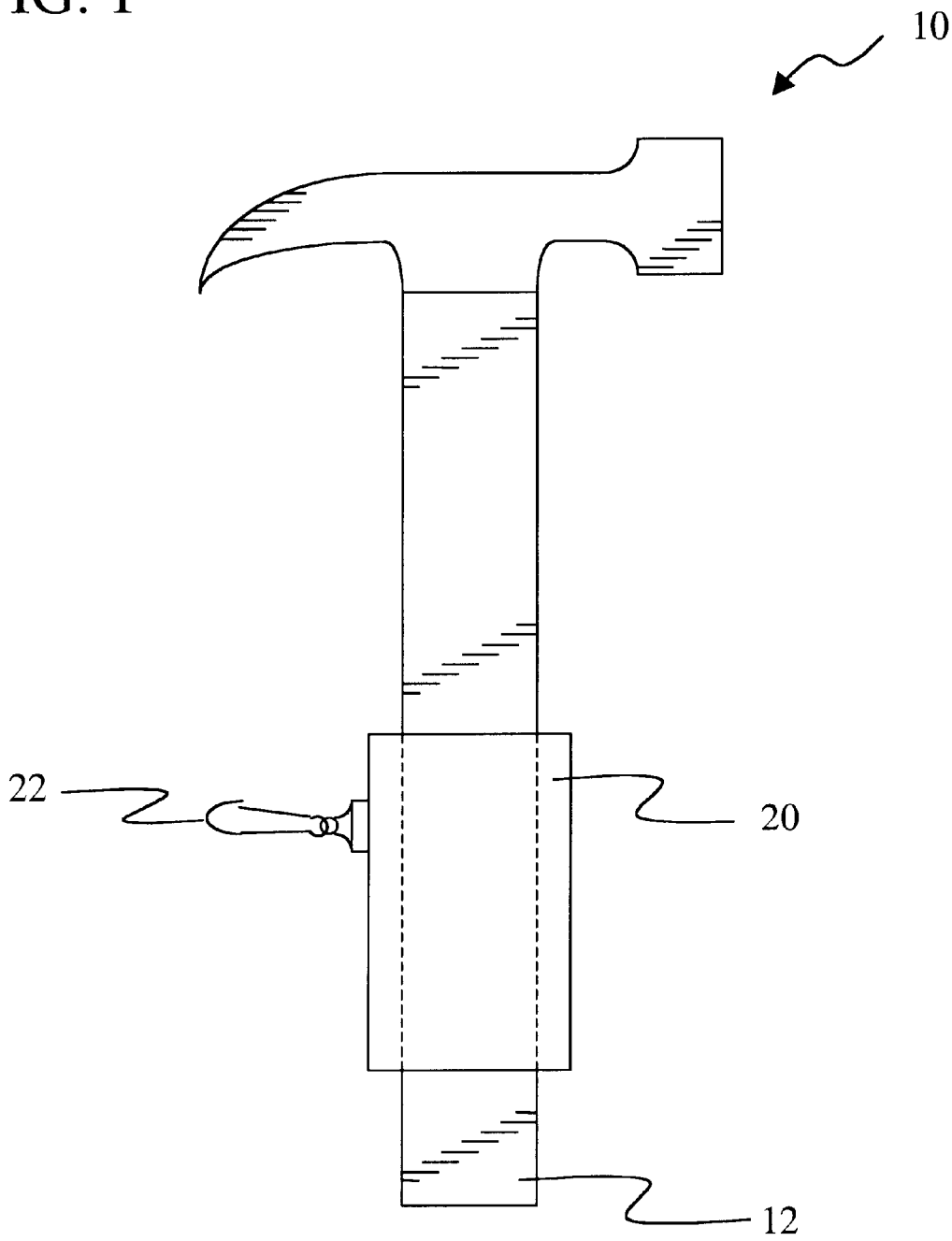
FIG. 1 is a schematic illustration of a tubular grip applied to the handle of a hand tool according to one embodiment of the invention.

Referring now to the figures of the drawing, the figures constitute a part of this specification and illustrate exemplary embodiments to the invention. It is to be understood that in some instances various aspects of the invention may be shown exaggerated or enlarged to facilitate an understanding of the invention.

The present invention discloses a grip which enables hand tools to float in a liquid such as water. FIG. 1 illustrates one embodiment of the invention comprising a tubular grip 20 positioned over a pre-existing grip of a hand tool 10. The tubular grip 20 is positioned so that the hand-tool will float with the grip of the hand-tool pointing up, thereby allowing the hand-tool can be easily seen and retrieved. The tubular grip 20 is made of a material that enables the hand-tool to float in water. In a preferred embodiment, the tubular grip can be manufactured from materials that include open or closed cell polyethylene, polypropylene, urethane, and other olyphene family products. The tubular grip 20 may also be coated with a sealant.

The tubular grip 20 can be applied over any pre-existing grip of any hand tool 10. Such hand tools might include hammers, screwdrivers, files, brushes, wrenches, and any other hand tools known to those of ordinary skill in the art. The present invention is particularly suited for tools made of metal which would quickly sink in water without the use of the present invention. The tubular grip 20 may be positioned anywhere along the handle 12 of the tool 10 according to the desire of the user. As shown in FIG. 1, the tubular grip 20 is positioned at some distance away from the edge of the handle 12; however, the tubular grip can extend to the handle edge if desired. The position of the tubular grip 20 will affect how the tool is positioned when floating in the water and thus how readily the tool can be seen and retrieved.

In another embodiment, the tubular grip 20 can include a means 22 of attaching the tubular grip to a retaining line or other mechanism. As shown in FIG. 1, the attaching means 22 is a lanyard eyelet.

In another embodiment, the tubular grip 20 can be made a material which allows the tubular grip to mold to the hand of the user. Such grip materials, as known to those of ordinary skill in the art, would provide the added advantage of enhanced comfort for a user.

Figure 2A:
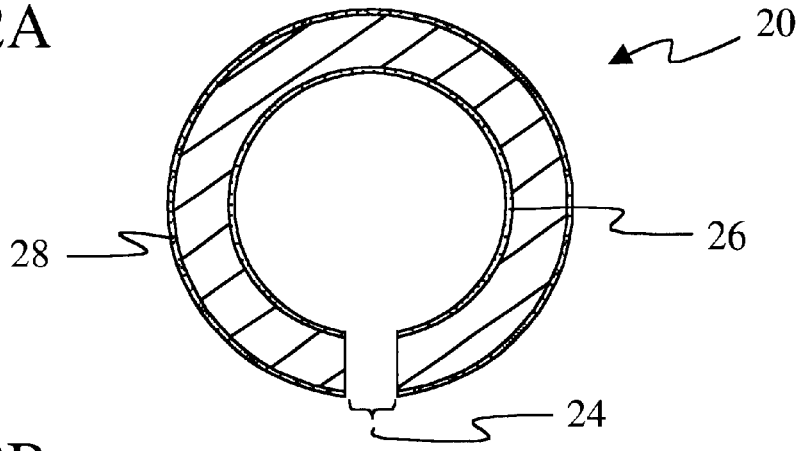
FIGS. 2A and 2B show a cross-sectional view and isometric view of a tubular grip according to one embodiment of the invention.
Figure 2B:
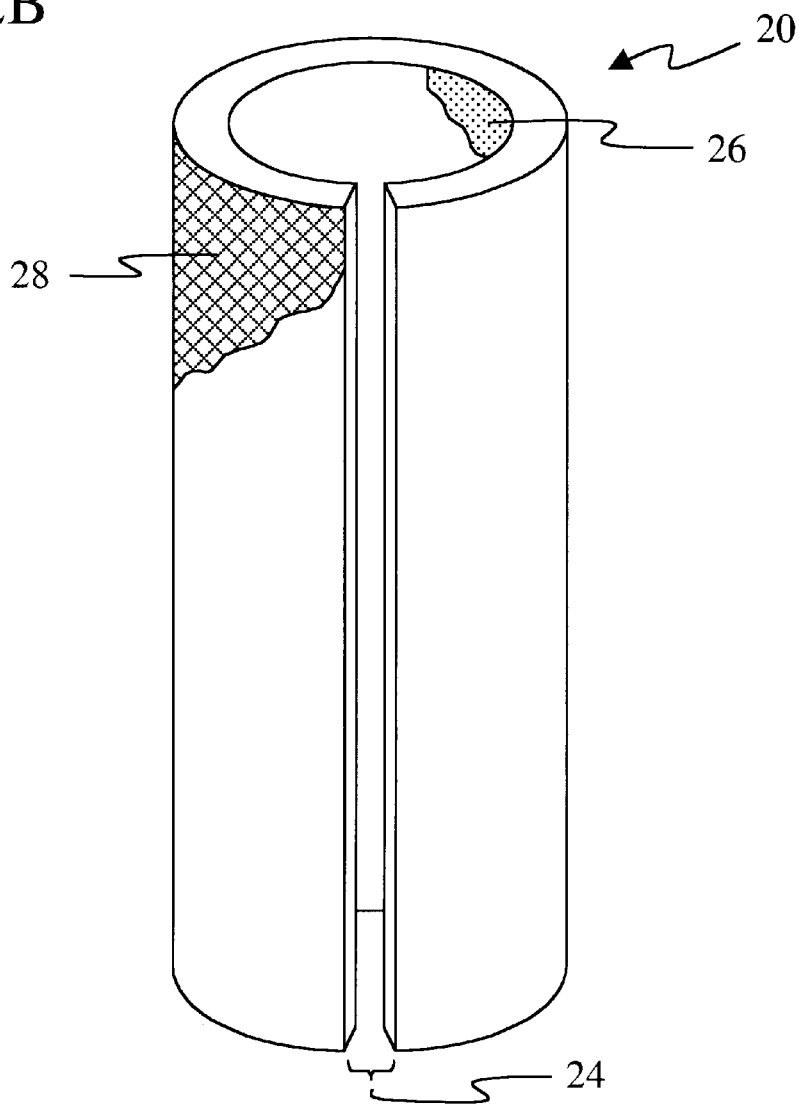

FIGS. 2A and 2B show a tubular grip according to one embodiment of the invention. The tubular grip 20 can be a temporary attachment to the handle 12 (or pre-existing grip) of the hand tool and attached to the handle by friction or a temporary adhesive. The tubular grip 20 may be slid, like a sleeve, over the handle. Alternatively, the tubular grip 20 may have an slit 24 on one side that allows the tubular grip to be opened, positioned around the handle of the hand tool, and then closed to provide a snug attachment to the hand tool 10. FIG. 2A is a cross-sectional view of the tubular grip 20 and FIG. 2B is an isometric view showing the slit 24 used to apply the tubular grip over the handle or pre-existing grip of the hand tool. The tubular grip 20 can be attached by temporary adhesion (e.g. friction) of the tubular grip with the handle, or alternatively, the tubular grip may be permanently attached over the handle by an adhesive or other permanent adhesion means 26. In another embodiment, the tubular grip 20 can be brightly colored or coated with a luminescent or highly reflective material 28 to enhance its ability to be seen and retrieved once dropped in water.

Figure 3:
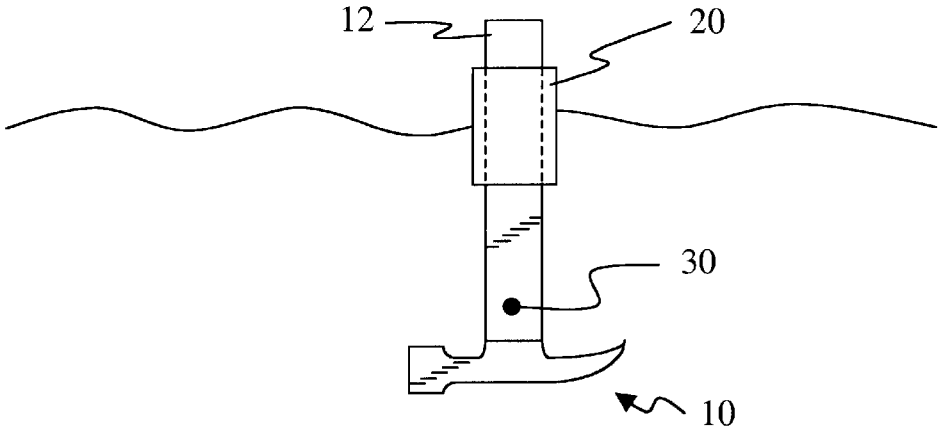
FIG. 3 is a schematic illustration of a hand tool with tubular grip floating grip side up in water according to one embodiment of the invention.

FIG. 3 is a schematic illustration of a hand tool with tubular grip floating grip side up in water according to various embodiments of the invention. The tubular grip 20 allows the hand tool 10 to be easily seen and retrieved if it is dropped into water. The tubular grip 20 can be positioned at any location along the handle 12 of the tool 10 as desired by the user to facilitate retrieval of the tool. Optimally, the tubular grip 20 should be positioned above the center of gravity 30 of the tool 10 (as shown in the FIG. 3), so that the handle and tubular grip 20 extend nearly perpendicular to the surface of the water.

Figure 4:
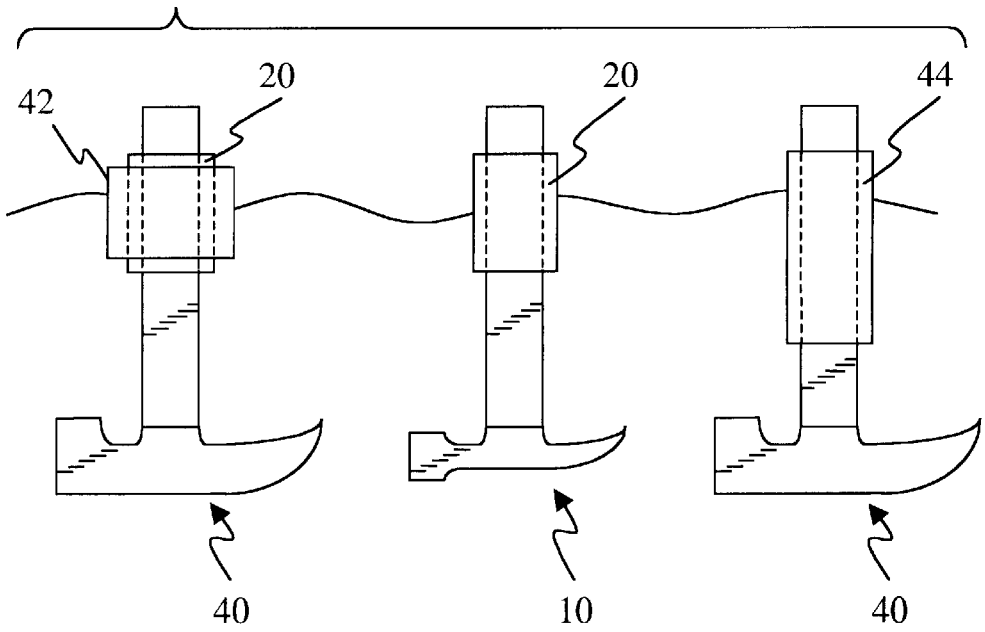
FIG. 4 is a schematic illustration of various embodiments of customized tubular grips.

The tubular grip 20 should be designed with appropriate buoyancy so that the tool 10 floats in the water. The characteristics of the tubular grip and its position on the tool handle can be designed to suspend the tool at a desired position in the water. For example, the tubular grip can be designed such that the tool is suspended just below the water's surface, or alternatively, it can be designed so that a portion of the handle extends above the water's surface. In another embodiment, tubular grips may be customized to individual tools depending on the weight of the tool. For example, tubular grips may be designed with different materials to customize buoyancy, or alternatively, tubular grips may be designed in different sizes so that multiple grips may be applied to a single tool. FIG. 4 is a schematic illustration of various embodiments of customized tubular grips. A large tool 40 can utilize a standard tubular grip 20 as well as an overlapping customized tubular grip 42 to maintain desired buoyancy. Alternatively, the large tool 40 can utilize a tubular grip 44 that is customized by extended length or manufactured of material with increased buoyancy.

The tubular grip can be produced and sold as individual units for use with individual tools. Alternatively, the tubular grip can be sold in bulk, i.e. it could be produced in large pieces, for example 3 feet, and cut by a user to a desired length.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. An apparatus which enables tools to float, comprising:

at least one tubular grip, wherein said tubular grip is applied over a handle of a tool and wherein said tubular grip is adapted to allow said tool to float in water, and wherein said tubular grip is coated with a sealant.

2. The apparatus of claim 1, wherein said tubular grip is a permanent attachment to the handle of said tool.

3. The apparatus of claim 1, wherein said tubular grip is adapted to allow said tool to float grip side up.

4. The apparatus of claim 3, wherein said tubular grip is positioned on said handle so that said handle and said tubular grip are approximately perpendicular to a surface of a body of water when said tool and said tubular grip are in said body of water.

5. The apparatus of claim 1, wherein said tubular grip is manufactured from a material that conforms to a user's hand so as to provide a comfortable grip.

6. An apparatus which enables tools to float, comprising:

at least one tubular grip, wherein said tubular grip is applied over a handle of a tool and wherein said tubular grip is adapted to allow said tool to float in water, and wherein said tubular grip is manufactured from a material selected from the group consisting of: open and closed cell polyethylene, polypropylene, urethane, and other olyphene family products.

7. An apparatus which enables tools to float, comprising:

at least one tubular grip, wherein said tubular grip is applied over a handle of a tool and wherein said tubular grip is adapted to allow said tool to float in water, and wherein said tubular grip is a temporary attachment to the handle of said tool.

8. An apparatus which enables tools to float, comprising:

at least one tubular grip, wherein said tubular grip is applied over a handle of a tool and wherein said tubular grip is adapted to allow said tool to float in water, and wherein said tubular grip comprises a luminescent or reflective coating on an exterior surface of said tubular grip.

9. An apparatus which enables tools to float, comprising:

at least one tubular grip, wherein said tubular grip is applied over a handle of a tool and wherein said tubular grip is adapted to allow said tool to float in water, and an attachment means installed on said tubular grip.

10. The apparatus of claim 9, wherein said attachment means is a lanyard eyelet.

11. An apparatus which enables tools to float, comprising:

at least one tubular grip, wherein said tubular grip is applied over a handle of a tool and wherein said tubular grip is adapted to allow said tool to float in water, and wherein said tubular grip is manufactured in bulk lengths.

12. An apparatus which enables tools to float, comprising:

at least one tubular grip, wherein said tubular grip is applied over a handle of a hand tool and wherein said tubular grip is adapted to allow said tool to float grip side up in water; and an attachment means installed on said tubular grip;

wherein said tubular grip is manufactured from a material selected from the group consisting of: open and closed cell polyethylene, polypropylene, urethane, and other olyphene family products; and wherein said tubular grip is coated with a luminescent or reflective coating on an exterior surface of said tubular grip.

13. A method for enabling hand tools to float, comprising:

attaching at least one tubular grip to a handle of a tool, wherein said tubular grip is adapted to allow said tool to float in water;

positioning said tubular grip at a location on said handle so that said handle and said tubular grip are approximately perpendicular to a surface of a body of water when said tool and said tubular grip are in said body of water, wherein said tubular grip is coated with a sealant.

* * * * *